US005879006A

United States Patent [19]

Bowling

[11] Patent Number: 5,879,006

[45] Date of Patent: Mar. 9, 1999

[54] METHOD OF PLAYING A THREE DICE GAME

[76] Inventor: James P. Bowling, 619 Forest Lake Dr., Seabrook, Tex. 77586

[21] Appl. No.: 767,687

[22] Filed: Dec. 17, 1996

[51] Int. Cl.[6] ..... A63F 3/00

[52] U.S. Cl. ..... 273/274

[58] Field of Search ..... 273/274, 146, 273/309

[56] References Cited

U.S. PATENT DOCUMENTS

| | | | |
|---|---|---|---|
| 3,829,098 | 8/1974 | Umminger | 273/249 |
| 4,312,508 | 1/1982 | Wood | 273/274 |
| 4,635,938 | 1/1987 | Gray | 273/274 |
| 5,133,559 | 7/1992 | Page | 273/274 |
| 5,308,081 | 5/1994 | Bartle | 273/274 |
| 5,350,175 | 9/1994 | DiLullo et al. | 273/274 |
| 5,413,351 | 5/1995 | Franklin | 273/274 |
| 5,513,850 | 5/1996 | Vancura | 273/274 |
| 5,542,671 | 8/1996 | Stewart | 273/146 |
| 5,573,248 | 11/1996 | Parra et al. | 273/274 |

OTHER PUBLICATIONS

"Dice and Dice Games," Micrcosoft(R) Encarta. Copyrightt (c) 1993 Microsoft Corporation. Copyright (c) 1993 Funk & Wagnall's Corp.

"Gambling," Microsoft (R) Encarta. Copyright(c) 1993 Microsoft Corp. Copyright(c) 1993 Funk & Wagnall's Corporation.

"Sic–Bo", Tripp Plastics, Oct. 1994.

*Primary Examiner*—Benjamin H. Layno

[57] ABSTRACT

A dice game and game accessories which include a game board having a playing field for the throw of three hexahedral dice, each side marked with one member of a set of six discrete ordered indicia, and having a plurality sections of pictorial representations of the predicted outcomes, using said dice or the mechanical equivalent thereof, and using markers placed upon said sections representing the amount of wager placed, placement of said markers in relationship to said pictorial representations indicate the scope of the prediction of said wager. Players place their wagers upon said sections. One player called the shooter throws all three dice simultaneously. Oral wagers may be called to the dealer effective only for the throw of dice in process. The dealer marks the combination rolled, and the dealer removes losing one time wagers. The dealer then pays the winning wagers covering said combination. All other place bets remain and may be altered by the players before the next throw of the dice. The shooter continues successive throws to complete his hand. The shooter's hand ends when his roll of the three dice produces at least one die displaying the highest indicia and at least one die displaying the lowest indicia.

1 Claim, 5 Drawing Sheets

Player Marker

HOP Marker

Player Marker with HOP

METHOD OF PLAYING A THREE DICE GAME

FIELD OF THE INVENTION

The present invention related generally to the field of game of chance and amusement. Particularly, this invention relates to dice games and wagering or betting layouts and tables, such as casino dice game apparatus.

BACKGROUND OF THE INVENTION

A myriad of games of chance have developed to fulfill the desires of players for excitement, risk, and the perception of the possibility of actually winning the game. To fulfill these desires, game inventors have varied the type of chance means, methods of placing the wagers, the amounts of the wagers, the methods of computing the pay-off, the number of players, the participation of the players in the play of the game, and the participation of the players with one another.

Wagering games utilizing a deck of cards abound. Many players avoid these games because of their slow pace. Others are dissuaded from choosing this form of gaming because they find the learning of the game rules too time consuming, the game rules actually vary from one casino to another or the player finds himself playing against other players rather than against the house.

Roulette is a popular game of chance. Players are drawn to it by the attractive yet complex table layout and wheel. They can find their comfort zone for complexity and risk in one of the numerous wagering combinations, such as placing bets on the individual numbers, the color of the field of the winning number or whether the winning number is an odd or even integer. However, roulette fails to appeal to many players because of the dearth of player participation and because the wagers are won or lost wholly on a single spin of the wheel.

Slot machines are another popular form of gaming device. The spinning reels and simplicity of play attract players because the individual players comfort risk level can be totally adjusted by him in the selection of the particular machine he uses and by the amount of time he chooses to participate. To add excitement to this form of gaming. Inventors have developed various methods of forming networks of slot machines whereby the payoff on a winning combination is determined by the total play on all machines in the network. However, again this form of gaming becomes monotonous because of the little variety of play and the lack of player interaction.

Dice games, old and new, are abundant. The rolling dice are a source of fascination and provide suspense. When the player participates in rolling the dice he both feels that he has an element of control over the outcome of the throw and that he can succeed at profiting the game. He is definitely participating. When one player is the one rolling the dice, the other players can relate to him. It is an "us against the house" response.

Craps is an exciting dice game well known by name by many persons. The Encarta Encyclopedia calls craps "(t)he most popular dice game in the U.S." It is a form of the old English game of hazard. Its rules of play, however, are not so well known nor can they be. The rules of play are complex generally and vary widely among the sites which offer the game and among locales.

The basic elements of play common to most crap games follows: It is played with two dice, traditional cubes with a different number of spots on each side to represent the integers from one to six, inclusive. One player is the thrower of the dice. He makes a monetary bet, covered by one or more opponents. The sum of the dice are from two to twelve, inclusive. The player wins if the first throw totals 7 or 11, but he loses if 2, 3, or 12 is the total. In any of these five cases the wagering and throwing are repeated. If the throw totals 4, 5, 6, 8, 9, or 10, that number becomes the player's point, and the player continues his turn to throw until he throws his point again or until he throws a 7. If the point is made, the player wins, and continues his turn. However, if a 7 is thrown, the player forfeits both his wager and his right to throw again.

These basic elements of the play of craps have many variations. The probability that a given outcome of the throw of dice will be a winning combination varies as a function of the player's point which again varies during the play. The actual rules of play are not widely known not only because of the may variations but also because of the vast memorization of the outcomes and their relationships. Many novice player are reluctant to attempt the game as a result of the confusion of various rules and onerous effort required to understand the risks.

Because craps is popular with players, casinos must keep it on the floor but the table produces two costs for the casinos. The playing table alone consumes an average of 12 lineal feet of floor space. Then floor space must be allowed for the player to stand around the table. One craps table accommodates about twelve players but it requires two betting fields and usually four dealers and a pit boss. The resulting cost to the casino is quite high in relationship to the draw twelve players produce.

There exists a need for a game which more closely meets the player's needs for excitement, risk, risk management, quickly and easily understood play, and possibility of success. At the same time the game must meet the casinos need for profitability from the use of the game instead of a game already in use on its floor. The present invention fulfills these needs. It is a fast pace game of simple consistent rules, player participation, choices of risk offered by a variety methods of placing the wagers, and corresponding to varying pay-out on an attractive and novel layout. The house edge is fairly derived and the player will detect this fairness through the pay-out odds. The table and layout should require only one dealer, consume only nine lineal feet of floor space, and accommodate up to seven players. These features will increase the number of players to the game, both experienced and inexperienced players and decrease the costs to the casino, generating satisfaction in the players and profitability to the casino.

DISCLOSURE OF THE INVENTION

The inadequacies of the prior art have been eliminated in the present invention.

The invention herein disclosed provides a game, a method of wagering and gaming apparatus for playing it. Many variation could be made upon its play for the purpose of improving its interest range to meet differing ability levels, age group or media in which it could be produced.

The game apparatus includes a playing board upon which the player bets are placed in and around pictorial representations of the dice outcomes, descriptive phrases of those outcomes and combinations of both, placed in a plurality of areas by grouping the outcomes logically by type. The methods of betting could be altered, simplified, or reduced in number to accommodate the different players in a given market. Each area's ratio of pay-out is noted on the betting field. Again these could be altered as required when the method of wagering is varied. Another area of the board is for the rolling of the dice. One embodiment of the game simple requires the rolling of the dice by the player. One embodiment of the game would add to the betting area a section for jackpot betting.

The three dice shall be hexahedral, each of the six sides a different member of one or more sets of six indicia, numbers, colors, or other symbols. Each dice should be identical to the other two dice. If both color and another set are selected for the dice, the color and number then become inextricably associated. For the media chosen for the production of this invention, a mechanical equivalent for the dice could be employed.

Additionally the game uses a plurality of wagering markers of various denominations representing the monetary value of each marker determined by the player whose bets are represented by that color.

In a casino setting the game shall commence when the croupier, or dealer, indicates that the players should place their wagers upon the field containing sections with pictorial representations of the predicted outcomes and markers placed upon said sections representing the amount of wager placed, placement of said markers in relationship to said pictorial representations indicate the scope of the prediction of the wager. Then the player who is the shooter rolls the dice all three dice simultaneously, or the mechanical equivalent thereof. One embodiment of this invention would allow oral wagers may be called to the dealer effective only for the throw of dice in process. Another embodiment could allow the players to indicate with their markers that their bets are either place bets or hopping one roll bets. In this embodiment the dealer would determine if hopping one roll bets could be allowed. The dealer marks the combination rolled and pays the wagers covering said combination in the ratio denoted on the wagering field. The dealer removes one roll bets. All other place bets remain and may be altered by the players before the next throw of the dice. The shooter continues successive throws to complete his hand. The shooter's hand ends when his roll of the three dice produces at least one die displaying the highest indicia and one die displaying the lowest indicia.

BRIEF DESCRIPTION OF THE FIGURES

There are three figures to which reference will be made in the specification.

DESCRIPTION OF THE PREFERRED EMBODIMENT

This invention includes a layout for the game, the method of wagering, and the play of the game.

The Layout

Figure 1:
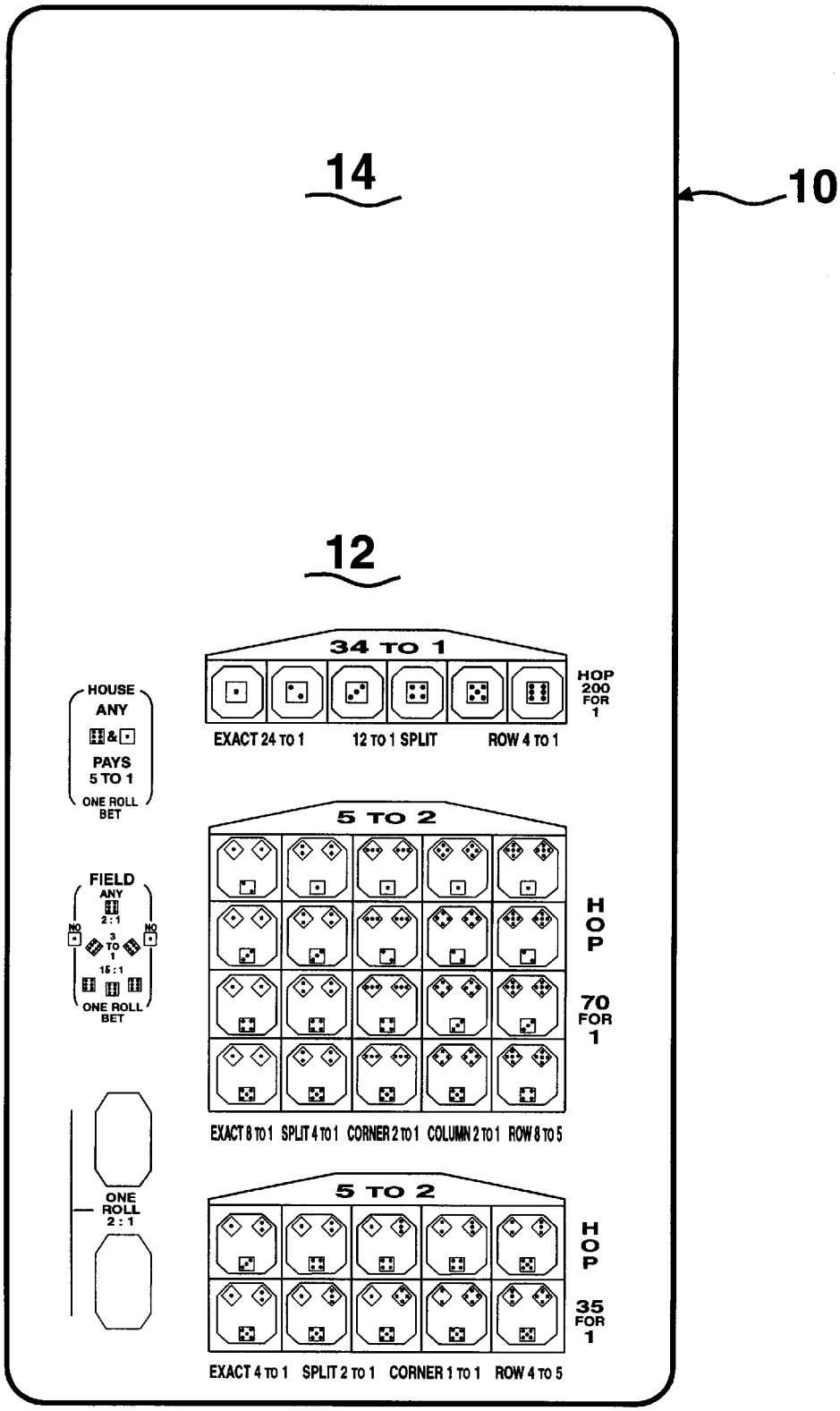
FIG. 1 is plan view of the playing board 10 forming part of the disclosed embodiment and contains two fields, the betting area 12 and the die rolling area 14.

First with reference to FIG. 1 the playing board 10 forming part of the disclosed embodiment and contains two fields, the betting area 12 and the die rolling area 14. It is similarly shaped to that of a craps table. The preferred embodiment would use a layout constructed for a table approximately nine feet in length and five feet in width and four feet three inches high, sufficient to support the display of all relevant fields. Another embodiment would scale the layout to a size to accommodate a standard size craps table.

Figure 2:
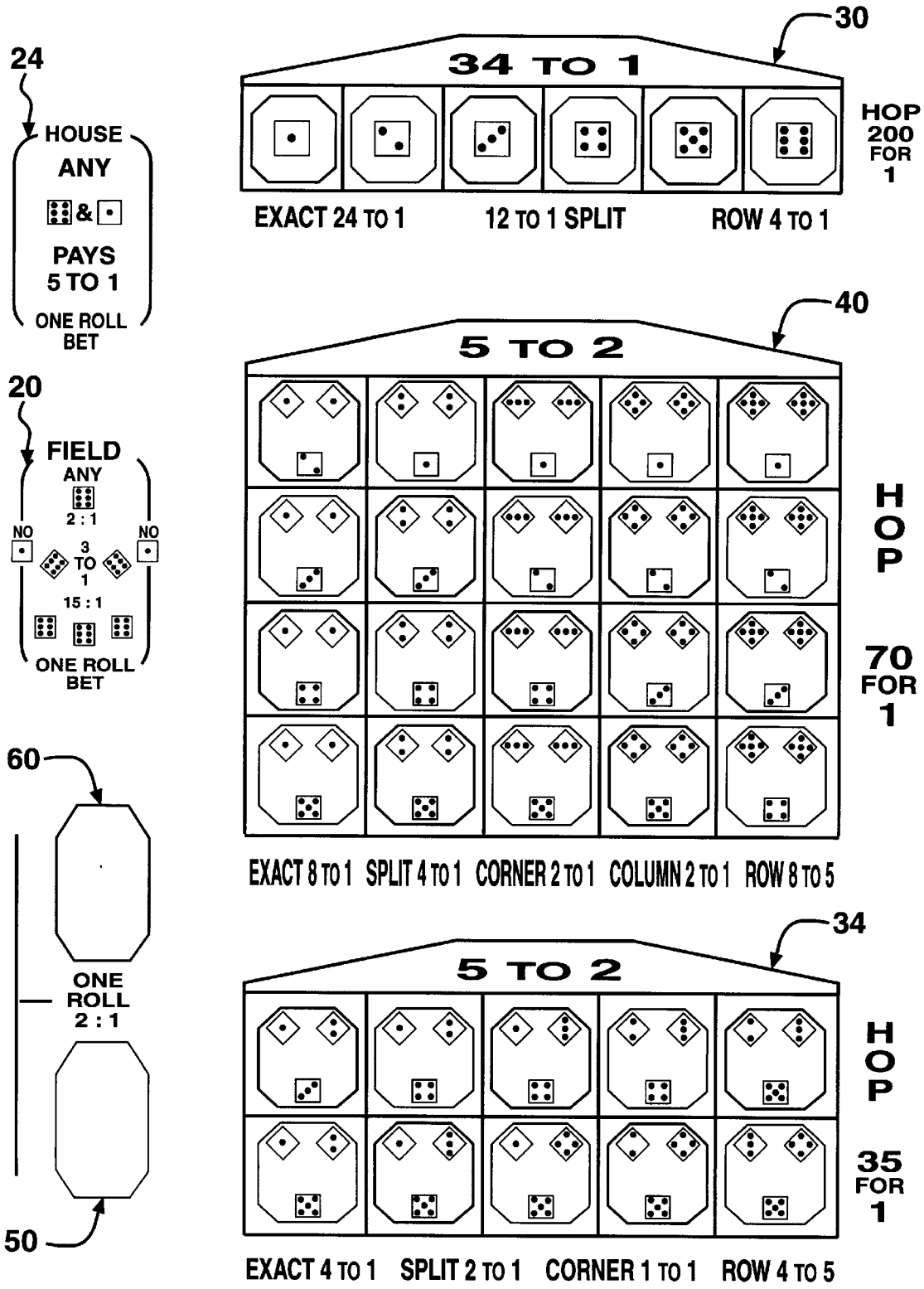
FIG. 2 is an enlarged plan view of the betting area 12 containing seven distinct betting selection areas 20, 24, 30 34, 40, 50, and 60.

Second with reference to FIG. 2 the betting area 12 contains pictorial representations of all possible combinations of the roll of three dice. Each pictorial representation of an combination is the representation of three dice within one of a plurality of shapes and/or colors within a rectangle or square defining its boundaries. These combinations are logically grouped into seven distinct betting selection areas defined by common characteristics of the possible combinations included in each section. The seven betting selection areas are as follows:

1. Field: Betting selection area 20 contains all possible combinations containing at least one six but no dice can have the outcome of one. Each bet placed here is a one roll bet.

2. House Wins: Betting field 24 contains the possible combinations which include at least one six and at least one one. These are the combinations for which the house wins the throw. Upon the event that a shooter's combination falls among the combinations in betting field 24, the shooter's hand is completed and he forfeits the throw of the dice to the next shooter. Any player may bet with the house. House Wins 34 bets are one roll bets.

3. Triple: Betting selection area 30 contains the pictorial representations of the six possible combinations in which each of the die has the same outcome in the same roll. A single roll with the combination of triple sixes is depicted in both the Field 20 and the Triple 30; however, Triple 30 bets are place bets unless the bet is made a hopping one roll bet by the player. Field 20 bets cannot be place bets.

4. Singles: Betting selection area 34 contains all possible combinations in which no two dice have the same value in the single roll and no die has the outcome of a six. The possible combinations of singles containing only one six are included in Field 20 and House Wins 24.

5. Pairs: Betting selection area 40 contains all possible combinations which contain two and only two outcomes which are the same value and no die has the outcome of six. The possible combinations containing two sixes or containing one six are contained in Field 20 and in House Wins 24. Pairs 40 bets are place bets unless they are made hopping one roll bet.

6. Red: Betting selection area 50 contains all combinations in both the Singles 34 and the Pairs 40 with pictorial representations of the background color red. Red 50 bets are one roll bets.

7. Black: Betting selection area 60 contains all combinations in both the Singles 34 and the Pairs 40 with pictorial representations of the background color black. The Black 60 bets are one roll bets.

Figure 3:
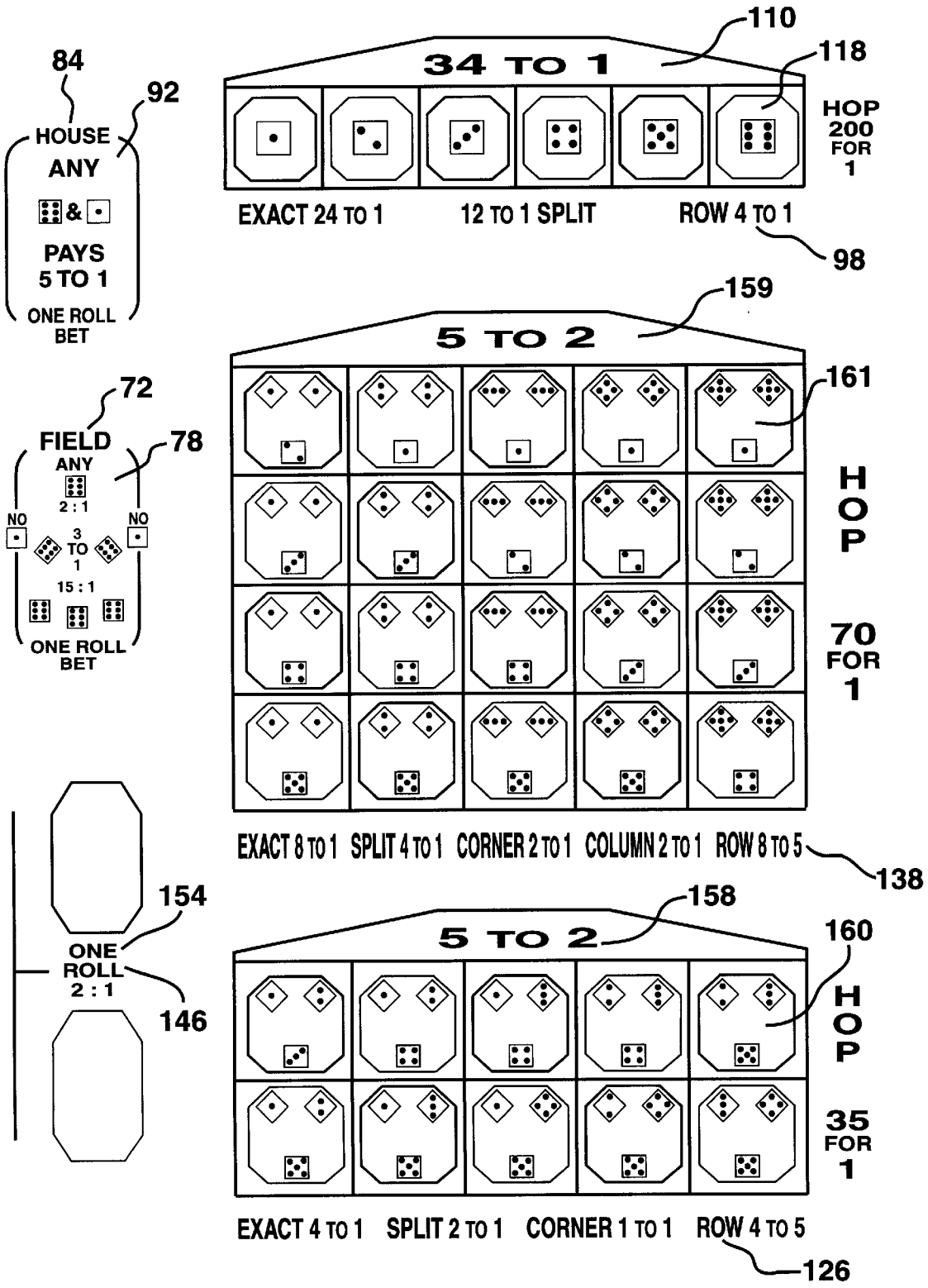
FIG. 3 is an enlarged plan view of the betting area 12 containing seven distinct betting selection areas 20, 24, 30 34, 40, 50, and 60, and details of the components of each area.
Figure 4:
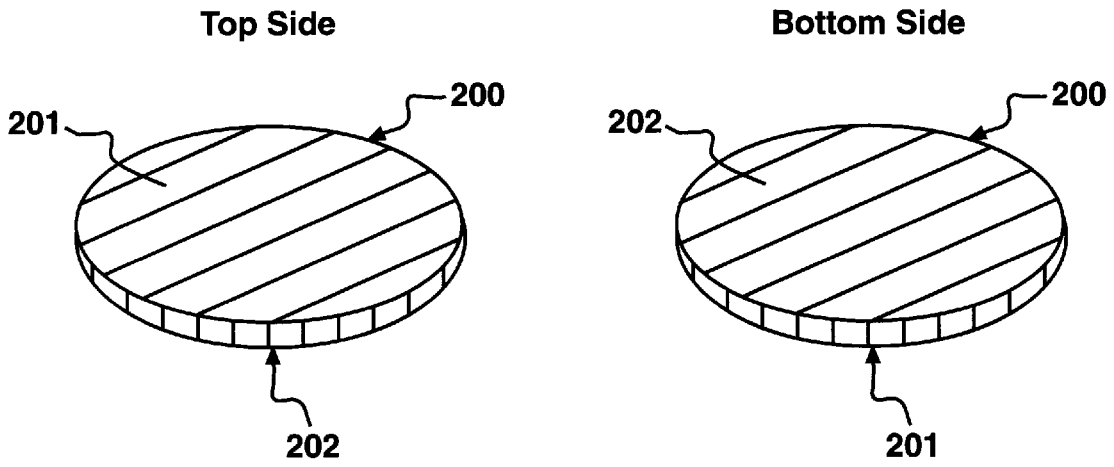
FIG. 4 is a view of the top side and the bottom side of a player marker, and a view of a hop marker.
Figure 4:
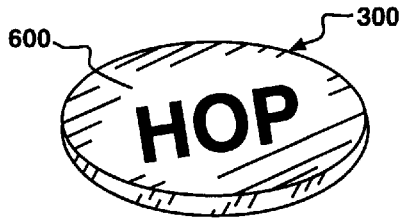
Figure 5:
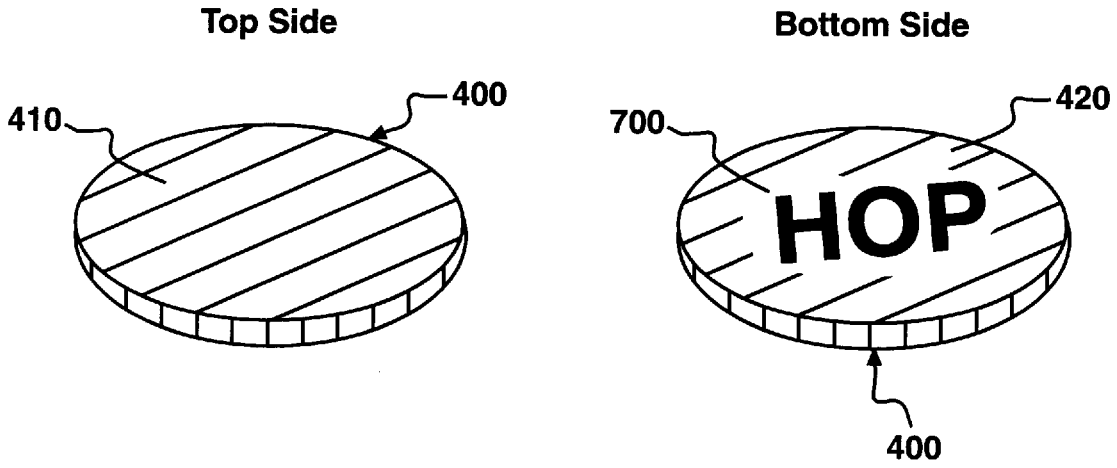
FIG. 5 is a view of the top side and the bottom side of a hop marker.

Finally with reference to FIG. 3 Field wording area 72 describes the types of bet allowed in Field 34. Field pictorial area 78 displays pictorial representations of the possible combinations included in the bet and the respective payoffs.

House Wins wording area 84 describes the types of bet allowed in House wins 24 and the payoff. House wins pictorial area 92 displays pictorial representations of the possible combinations included in the bet.

Triple wording area 98 and Triple wording area 110 describe the types of bets allowed in Triple 30 and the respective payouts. Triple 30 pictorial area 118 displays pictorial representations of the possible combinations which can be included in the bet.

Singles wording area 158 and singles wording area 126 describe the types of bet allowed in Singles 34 and the respective payoffs. Singles pictorial area 160 displays pictorial representations all possible combinations included in the bet, each combination enclosed within a pre-selected shape and color background and each combination and shape wholly contained in a square or rectangle.

Pairs wording area 159 and pairs wording area 138 describe the types of bets allowed in Pairs 40 and the respective payoffs. Pairs pictorial area 161 displays pictorial representations all possible combinations included in the bet, each combination enclosed within a pre-selected shape and color background and each combination and shape wholly contained in a square or rectangle.

Red wording area 146 contains the type of bet and its payoff and the color of red wording area 146 identifies the winning background color.

Black wording area 154 contains the type of bet and its payoff, and the color of Black wording area 154 identifies the winning background color.

Method of Wagering

Types of Bets

An outcome is the result of the roll of one dice.

A combination is a set of outcomes from the roll of three dice.

There are two basic types of bets differentiated by the time duration assigned to each bet's effectiveness. Within each of the two basic types are specific variations.

First Basic Bet: A one roll bet is one of various bets which are effective only for the current single roll of the dice. There are two variations of one roll bets.

1. A hopping one roll bet is one kind of one roll bet. Hopping one roll bets are made good for the single roll of the dice by the action of the player to indicate that the wager is intended by him to be effective for only the current roll of the dice, thereby increasing the payout associated with his wager.

a) In one embodiment of the game the player makes a hopping one roll bet by calling his predicted out which is an oral bet called to the dealer for the current single roll of the dice. The hopping one roll bet is a wager on only one possible combination in the Triple 30, Singles 34, or Pairs 40. Bets which cover more than one combination cannot be hopping one roll bets.

b) A second embodiment of the invention would not allow hopping one roll bets called orally. Instead the second embodiment would allow the player himself to designate the bet as hopping one roll by the manner in which the marker is displayed instead of called the wager orally to the dealer. For the player to designate the bet as hopping one roll, the player would position his wagering marker on a single pictorial representation of his predicted combination on the betting area 12, in Triple 30, Singles 34 or Pairs 40, with an indicia that the bet was hopping one roll on one side of the wagering marker placed upward. For use in this second embodiment of the game, the wagering marker must contain one side which displays the hopping one roll indicia and the opposite side which does not display that indicia. If the player does not place his maker with the hopping one roll indicia displayed for the dealer to see, the wager is not a hopping one roll bet. Instead the bet not displaying the hopping one roll indicia is a place bet.

c) A third embodiment of the game includes both the oral hopping one roll bet of the first embodiment and the player placed hopping one roll bet of the second embodiment, 2. The second type of one roll bet is an any bet. The any bet is a one roll wager which contains in its prediction that one combination in the predetermined field which contains more than one combination will be the winning combination. An any bet is allowed in the predetermined fields: Red 50, Black 60, Field 20, House Wins 24, Triple 30, Singles 34 and Pairs 40. The any bet is the only bet in Red 50 and Black 60 because the bet is the prediction of the background color of the pictorial representation of the winning combination. The any bet is the only bet available in House Wins 24 because there is no option to select a single combination containing a six and a one. The any bet is the only bet available in Field 20 because there is no option to select a single combination containing a six and no one The any bet is a bet which contains in its prediction any one of the combinations available in the betting selection area upon which the marker is placed upon the wording area 110 in Triple 30, wording area 158 in Singles 34, or wording area 159 in Pairs 40.

One roll bets of any of the above types have the effective duration of only the current roll of the dice. If the prediction of the wager is the winning combination, the wager is paid after the winning combination is determined by the shooter's roll of the dice. If the prediction of the wager is not the winning combination, the wager loses and is removed by the dealer after the winning combination is determined by the shooter's roll of the dice.

One roll bets incur more risk of loss by the player, and the payout ratio is proportionately higher than a place bet.

Second Basic Bet: A place bet is a wager which remains effective as the player's wager until one of the House Wins 24 possible combination is the result of the shooter's roll or until the player who makes the place bet withdraws it or alters it.

There are five place bets possible in the Triple 30, Singles 34, and Pairs 40 A player indicates the type of bet he is wagering by the position of his marker within the betting selection area. The five place bets are defined and described below in descending order of risk:

1. An exact bet is a wager on only one possible combination. It is indicated by placing the wagering marker within the boundaries of the pictorial representation of that combination.

2. A split bet is a wager to include either of two possible combinations. It is indicated by placing the wagering marker on the solid line boundary between two adjoining pictorial representations of the combinations selected for the wager.

3. A corner bet is a wager to include any one of four possible combinations. It is indicated by placing the wagering marker on the intersection of the horizontal and vertical lines which separate the four possible combinations selected for the wager.

4. A column bet is a wager to include all possible combinations whose pictorial representations occur in one column. The number of possible combinations will vary with the betting section selected and the configuration of the possible combinations in a grid. As a result the payoff ratio would vary to reflect the risk assumed. The column bet is indicated by placing the wagering marker on the horizontal solid line at the top of the first pictorial representation in the column.

5. A row bet is a wager to include all possible combinations whose pictorial representations occur in one row. The number of possible combinations will vary with the betting section selected and the configuration of the possible combinations in a grid. As a result the payoff ratio would vary to reflect the risk assumed. The row bet is indicated by placing the wagering marker on the vertical solid line at the left or the right of the first pictorial representation in the single row selected as containing the combinations to be covered by the bet.

6. A double row place bet is a wager to include all possible combinations whose pictorial representations occur in two consecutive horizontal rows. The number of possible combinations included in this bet will vary with the betting section selected and the configuration of the possible combinations in a grid. As a result the payoff ratio would vary to reflect the risk assumed. The double row bet is indicated by placing the wagering marker on the intersection of the vertical solid line at the left or the right of the first pictorial representation in the rows selected and the solid horizontal line which separates the two horizontal rows selected.

Of the five types of place bets, only the exact bet can be made a hopping one roll bet by action of the player.

Types Of Bets Within Each Betting Selection Area

Field 20: Only one roll any bets are available. This one roll bet wins if at least one six, and no one is in the combination. The bet includes all possible combinations in which that minimum requirement is met, but the less likely the combination's occurrence the higher the payoff to the player. When exactly one six is rolled and the other two dice have value two, three, four or five, the player is paid by those payoff odds. When exactly two sixes are rolled with a two three, four, or five on the third die, the player is paid at a greater rate of return. When three sixes are rolled, the payoff is at an even greater rate. When none of these three events occurs the player loses his wager.

House Wins 24: Only one roll any bets are available. If at least one six and at least one one occur in the combination the player wins. The payoff rate is constant for all possible combinations.

Red 50: Only one roll any bets are available. Any combinations in both the Singles 34 and the Pairs 40 with pictorial representations of the background color red wins this low risk bet. If a color other than red appears in the background of the combination the player loses his wager.

Black 60: Only one roll any bets are available. Any combinations in both the Singles 34 and the Pairs 40 with pictorial representations of the background color black wins this low risk bet. If a color other than black appears in the background of the combination the player loses his wager.

Triple 30: Only exact, split, corner, row and double row place bets are available. These place bets are place one the section Triple 30 as described in Types of Bets, above. One roll any bets are placed on wording area 110, and one roll hopping bets are allowed on any single combination represented in the Triple pictorial area 118.

Singles 34: Only exact, split, corner, row and double row place bets are available. These place bets are place one the section Triple 30 as described in Types of Bets, above. One roll any bets are placed on Singles wording area 158. One roll hopping bets are allowed on any single combination represented in Singles pictorial area 160.

Pairs 40: All five place bets are possible. These place bets are place one the section Triple 30 as described in Types of Bets, above. One roll any bets are placed on Pairs wording area 159. One roll hopping bets are allowed on any single combination represented in Pairs pictorial area 161.

One embodiment of the game includes a Jackpot area where wagers are place on the possibility that certain triples would be the combination of the roll of the dice on each of two consecutive rolls of the dice.

The methods of betting could be altered, simplified, or reduced in number to accommodate the different players in a given market.

The ratio of pay-out could be altered as required when the method of wagering is varied.

The Play of the Game

Players buy from the dealer designed color markers to identify their bets. The dealer notes the denomination of each player's marker.

The dealer indicates to the players that the players should place their bets.

The players place their bets on the betting area 12 in the manner above described above.

A shooter is designated. The shooter rolls the three die simultaneously, hopping one roll bets are noted by the dealer, and the winning combination is determined and marked by the dealer.

The dealer removes all losing one roll any bets and one roll hopping bets. The dealer then pays all winning wagers on the winning combination: one roll any bets and one roll hopping bets and place bets. The winning and losing place bets stand or can be altered by the players who placed them. Players may also add new bets, delete bets, or may cease to bet, and new player(s) may be added when space allows.

The shooter continues until a house wins 92 combination occurs. At that time the dealer pays all one roll bets with the house, removes all losing place bets and one roll bets, and designates a new shooter.

Players again place bets and the cycle continues.

The Other Apparatus

The game will use three dice which shall be hexahedral, each of the six sides a different member of one or more sets of six indicia, numbers, colors, or other symbols. Each dice should be identical to the other two dice. If both color and another set are selected for the dice, the color and number then become inextricably associated. For the media chosen for the production of this invention, a mechanical equivalent for the dice could be employed.

Additionally the game will use a plurality of wagering markers of various denominations representing the monetary value of each marker determined by the player whose bets are represented by that color. In one embodiment the marker has a word or indicia on only one flat surface to indicate a hopping one roll bet.

The above described embodiment should not be constructed to limit the invention to the exact details of structure described therein. Those persons skilled in the art which this invention applies will readily identify modifications which are not specifically described but are intended to be covered.

I claim:

1. A method of playing a dice game having a dealer and a plurality of players comprising the steps of:

a) providing three identical hexahedral dice, each side of each dice being adorned with a different indicia representing a number from one to six, inclusive;

b) providing a plurality wagering markers, each of said wagering marker having a first indicia identifying a specific player wherein each player is assigned a set of wagering markers, each wagering marker also having a second indicia on only one side of the wagering marker, and the opposite side of the wagering marker having no second indicia;

c) providing a playing board having a betting area and a die rolling area, the betting area having a plurality of separate betting selection areas, each betting selection area having a plurality of representations of the possible combinations of the roll of three dice, wherein the plurality of representations of the possible combinations of the roll of three dice on any one selection area is different from the plurality of representations of the possible combinations of the roll of the three dice on all the other selection areas, a plurality of said betting selection areas each being divided by intersecting vertical and horizontal boundary lines forming areas defining each representation of the possible combinations of the roll of the three dice in the said betting selection areas, said areas defining each representation of the possible combinations of the roll of the three dice forming rows and columns in said betting selection areas;

d) assigning a set of wagering markers to each player;

e) one of said players being designated by said dealer as a shooter;

f) each player making one or more bets by placing one or more wagering markers on one or more betting selection areas, wherein each player being allowed to make a plurality different types of bets, and wherein each betting selection area having indicia for indicating the type of bet or bets allowable in that betting selection area, the different types of bets include:

i) allowing the players to make a one roll hopping bet by placing a wagering marker with the second indicia face-up or the dealer marking the wagering marker with a unique indicating marker within the boundaries of only one area representing one possible combination of the roll of three dice in a betting selection area where one roll hopping bets are allowed, said second indicia or said unique indicating marker indicating that the bet is a one roll hopping bet wherein the player placing the one roll hopping bet is predicting that the said one possible combination of the roll of the three dice will occur only on the next roll of the three dice;

ii) allowing the players to make an one roll any bet by placing a wagering marker on an area having indicia indicating that one roll any bets are allowed in a betting selection area, said area having indicia indicating that one roll any bets are allowed being separate from areas representing possible combinations of the roll of the three dice in said betting selection area, said one roll any bet indicating that a player is predicting that any one of the possible combinations of the roll of the three dice in the said betting selection area will occur only on the next roll of the three dice;

iii) allowing the players to make an exact place bet by placing a wagering marker within the boundaries of only one area representing one possible combination of the roll of three dice in a betting selection area where place bets are allowed, the exact place bet indicating that a player is predicting that said one possible combination of the roll of the three dice will occur on the next plurality of subsequent rolls of the three dice before a predetermined possible combination is rolled, or until the player making said exact place bet moves it to another area representing possible combinations of the roll of the three dice, or until the player withdraws it;

iv) allowing the players to make a split place bet by placing a wagering marker on a boundary line between two areas representing two possible combinations of the roll of the three dice in a betting selection area where place bets are allowed, said split place bet indicating that a player is predicting that any of said two possible combinations of the roll of the three dice will occur on the next plurality of subsequent rolls of the three dice until a predetermined possible combination is rolled, or until the player making said split place bet moves it to another area representing possible combinations of the roll of the three dice, or until the player withdraws it;

v) allowing the players to make a corner place bet by placing a wagering marker on an intersection of boundary lines which separate four areas representing four possible combinations of the roll of the three dice in a betting selection area where place bets are allowed, the corner place bet indicating that a player is predicting that any of said four possible combinations of the roll of the three dice will occur on the next plurality of subsequent rolls of the three dice until a predetermined possible combination is rolled, or until the player making said corner place bet moves it to another area representing possible combinations of the roll of the three dice, or until the player moves it to another area representing possible combinations of the roll of the three dice, or until the player withdraws it;

vi) allowing the players to make a column place bet by placing a wagering marker on a horizontal boundary line at the top of a column of areas representing possible combinations of the roll of the three dice in a betting selection area where place bets are allowed, the column place bet indicating that a player is predicting that any of said possible combinations of the roll of the three dice represented in said column of areas will occur on the next plurality of subsequent rolls of the three dice until a predetermined possible combination is rolled, or until the player making said column place bet move it to another area representing possible combinations of the roll of the three dice, or until the player withdraws it;

vii) allowing the players to make a row place bet by placing a wagering marker on a vertical boundary line at the left or right of a single row of areas representing possible combinations of the roll of the three dice in a betting selection area where place bets are allowed, the row place bet indicating that a player is predicting that any of the said possible combinations of the roll of the three dice represented in said single row of areas will occur on the next plurality of subsequent rolls of the three dice until a predetermined possible combination is rolled, or until the player making said row place bet moves it to another area representing possible combinations of the roll of the three dice, or until the player withdraws it;

viii) allowing the players to make a double row place bet by placing a wagering marker on an intersection of a vertical boundary line at the left or right of two adjacent rows of areas representing possible combinations of the roll of the three dice, and a horizontal boundary line which separates the two horizontal rows in a betting selection area where place bets are allowed, the double row place bet indicating that a player is predicting that any of the said possible combinations of the roll of the three dice in said two rows of areas will occur on the next plurality of subsequent rolls of the three dice until a predetermined possible combination is rolled, or until the player making said double row place bet moves it to another area representing possible combinations of the roll of the three dice, or until the player withdraws it;

g) the shooter rolling the three dice, and the dealer observing the resulting combination of the roll of the three dice;

h) the dealer determining a winning combination if the resulting combination of the roll of the three dice matches any of the areas representing possible combinations of the roll of the three dice where one roll hopping bets, one roll any bets, or place bets were placed in steps f) i) through f) viii) above;

i) if a winning combination is determined, the dealer marking the wagering markers on the matched areas representing possible combinations of the roll of the three dice, and the dealer rewarding said players whose wagers include said winning combination, the players also collecting their one roll hopping bets and one roll any bets which were placed in said matching areas representing possible combinations of the roll of the three dice;

j) the dealer removing and collecting all wagering markers representing one roll hopping bets and one roll any bets that were placed in areas representing possible combinations of the roll of the three dice that do not match said resulting combination of the roll of the three dice;

k) keeping all the place bets, placed in steps f) i) through f) viii) above, on the bet selection areas;

l) repeating steps f) through k) until said shooter rolls a predetermined possible combination, wherein all place bets are removed and collected by the dealer, and another one of said players being designated by the dealer to be the shooter.

* * * * *